United States Patent [19]

Hsien

[11] 4,277,912

[45] Jul. 14, 1981

[54] GYROSCOPE-MONOCYCLE

[76] Inventor: Shou-Chung Hsien, 40 Wun-Chang Rd., Shan-Hwa Chen, Tainan Hsien, China

[21] Appl. No.: 78,678

[22] Filed: Sep. 25, 1979

[51] Int. Cl.[3] ..... A63H 1/00

[52] U.S. Cl. ..... 46/269; 46/50

[58] Field of Search ..... 46/269, 50, 248, 66, 46/73, 251

[56] References Cited

U.S. PATENT DOCUMENTS

| | | | |
|---|---|---|---|
| 2,107,672 | 2/1938 | Lang | 46/234 X |
| 3,246,427 | 4/1966 | Tuuri | 46/269 |
| 3,253,365 | 5/1966 | Calderon | 46/269 |
| 3,533,187 | 10/1970 | Campbell | 46/269 |
| 3,550,317 | 12/1970 | Brown | 46/269 |
| 3,628,285 | 12/1971 | Murakami | 46/269 |

FOREIGN PATENT DOCUMENTS

| | | | |
|---|---|---|---|
| 1009079 | 5/1957 | Fed. Rep. of Germany | 46/269 |

*Primary Examiner*—Gene Mancene

*Assistant Examiner*—Mickey Yu

*Attorney, Agent, or Firm*—Cushman, Darby & Cushman

[57] ABSTRACT

A flying saucer-shape gyroscope monocycle that stands by its own gyroscope action. The device is composed of a transparent plastic-made upper dish-rotor and a lower dish body. A small D.C. motor is installed in a central hole of the lower dish body and is powered by two small batteries. The shaft of the motor is fitted tightly with the upper rotor so as to drive the rotor. High speed rotation of the upper rotor causes slits on the surface to buzz continuously. The unbalanced force of the high speed rotating upper rotor causes the whole gyroscope to vibrate and thus a vibrating switch disposed in the lower dish body contacts intermittently to cause a bulb connected thereto to flash intermittently. The flashing is visible through the transparent upper rotor and a side window in the lower dish body. Satellite bodies disposed along a circular flange on the lower body rotate counterclockwise by the reaction to the motor driving torque.

9 Claims, 5 Drawing Figures

GYROSCOPE-MONOCYCLE

BACKGROUND AND SUMMARY OF THE INVENTION

The invention is a flying saucer shaped gyroscope consisting of a convex upper dish rotor and a lower dish body which in operation stand on an inverted T-base due to the high speed rotation of the upper rotor which is driven by the mini-motor installed in a central hole of the lower dish body. Slits on the upper rotor buzz continuously. During high speed rotation the unbalance forces of the high speed rotation cause the two terminals of a vibrating switch to contact intermittently to cause a bulb to flash on and off. The invention is thus an attractive toy with sound, motion, and light.

The gyroscope has been an attractive toy since a long time ago. But the motored gyroscope is a far more exciting toy compared to a traditional one. According to this invention, there is a cone column under the lower dish body to confine the gyroscope. When the gyroscope stands due to the gyroscope action, owing to the reaction of the driving torque of the upper rotor, the lower dish body, accompanied with the whole gyroscope, rotates slowly to make the gyroscope more attractive. This is one aim of the invention.

According to this invention, the upper rotor is eccentrically fitted with the shaft of the motor so as to make the whole body vibrate by unbalanced force. A narrow steel wire vertically disposed when it vibrates in a confined socket acts as a terminal which contacts with a fixed terminal to make the bulb flash intermittently. This is another goal of this invention.

According to this invention attachable satellites can be removed from the gyroscope so as to permit the gyroscope to rotate forward along the flange of the lower dish body. This movement is due to the gyroscope action of the upper rotor, the reacting torque of an inserted leaf propelling to the air and the eccentricity of the mass center of gravity of the gyroscope with respect to the center of the flange. The gyroscope thus rotates forward in a circular path. This is another effect of this invention.

Further understanding of these and other aspects of the above invention may be understood from the following detailed description of the preferred embodiment in connection with the appended drawings in which.

Figure 1:
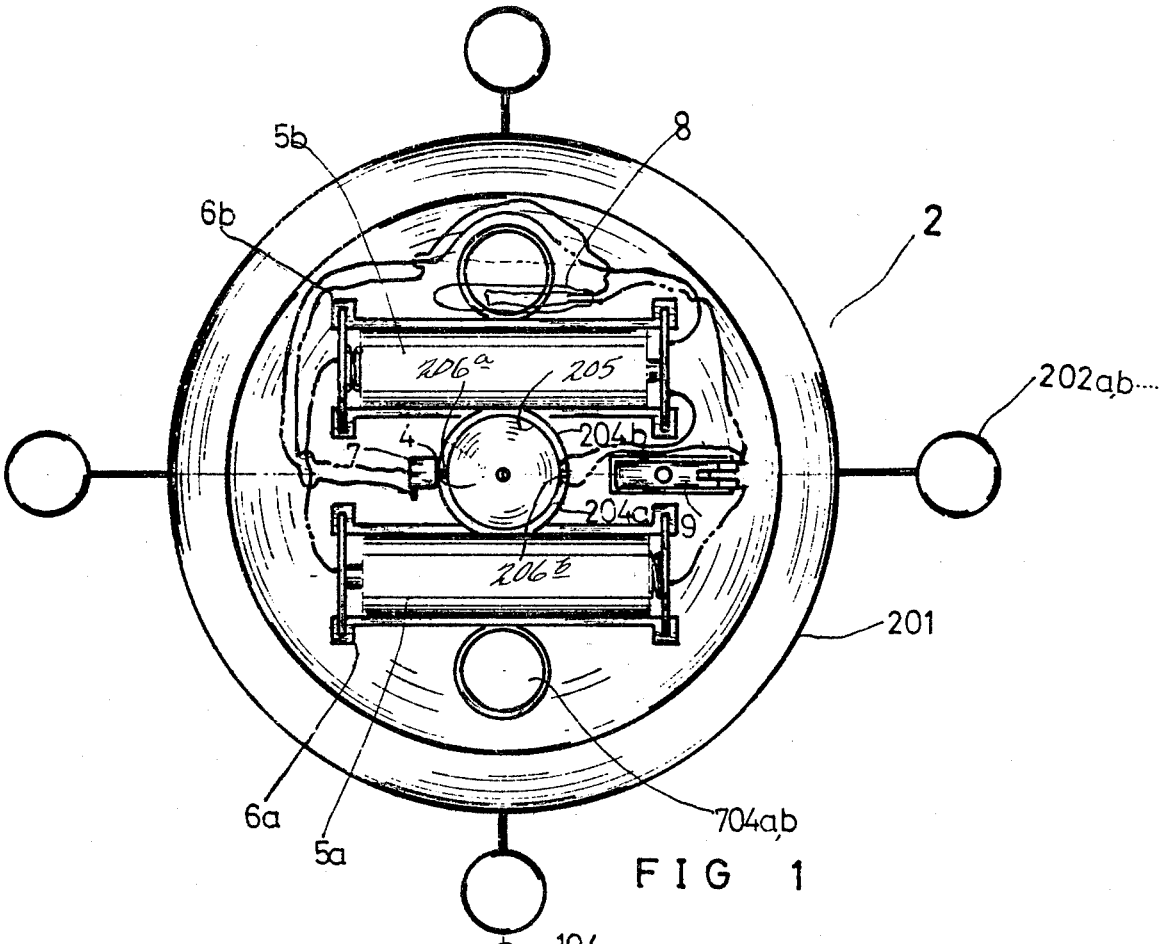
FIG. 1 is a plan view of the invention, with the upper rotor removed.
Figure 2:
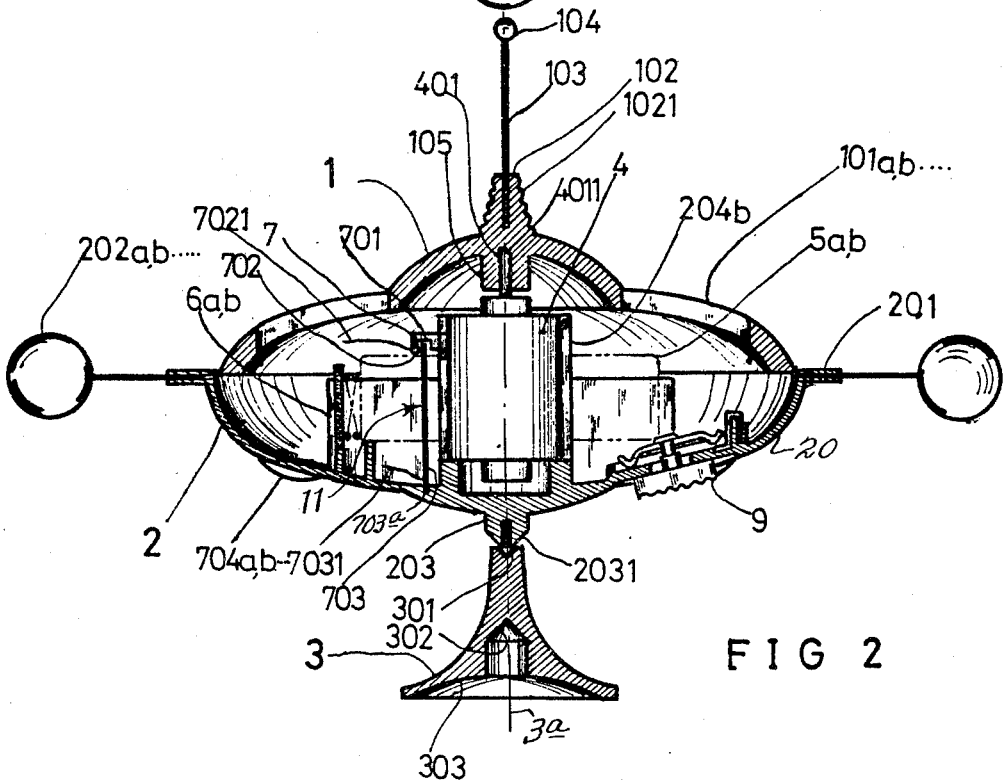
FIG. 2 is a front sectional view of this invention.
Figure 3:
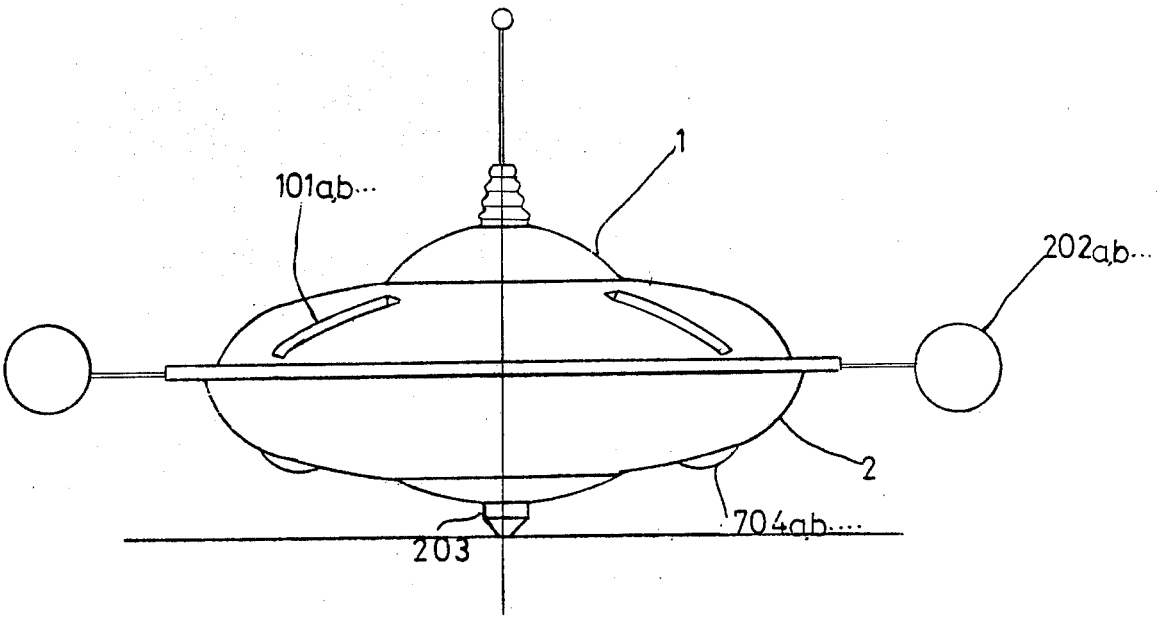
FIG. 3 shows the invention standing on the ground as a gyroscope.

Referring to FIGS. 1 and 2, the invention is composed of upper dish rotor 1, lower dish body 2 and stool-base 3 having a central axis of rotation 3*a*. Upper rotor 1 may be made of PS plastic with a convex surface. There are several slits 101*a, b,* . . . on the surface. There is a knurled taperd column 102 with an antenna 103 in it on the center part of the upper rotor. Referring to FIG. 2, there is shown a central hole 105 in the upper rotor to match with the following motor shaft 401.

Referring to FIG. 2 lower dish body 2 is a shallow dish 20 having a flange 201 made of anti-impact plastics such as PE. There are several satellites 202*a, b,* attached on the flange in a symmetrical direction.

Under the lower dish body 2 is a supporting column 203 with a cone end 2031. In FIGS. 1 and 2, there are shown two semi-circular thin sleeves 204*a, b,* forming a central deep hole 205. The mini motor 4 is fitted tightly in the hole by the spring-back force of the two plastic semi-circular sleeves 204*a, b.* The upper end of the motor shaft 401 is not limited to this type. The half circular end is just for illustration. Any other shape matching each other to ensure proper driving between upper rotor 1 and motor shaft 401 will be all right.

Referring to FIGS. 1 and 2, on opposite sides of the motor 4 there are horizontal-located 1.5 V batteries 5*a* and 5*b,* clamped by the battery terminals 6*a, 6b.* At a suitable altitude in the slits 205*a* and 206*b* between the two circular holding sleeves 204*a, b,* is inserted a cave-like plastic holder 7 with a fixed electrical wire terminal. Another terminal 702 on the side wall in a shallow hole 701 in the underside of the holder 7 is connected with electric wire 7021.

A vibrating steel wire 703 standing in a socket 703*a* on the lower dish body 2, extends upward into the cave 701 of the holder 7 to an altitude higher than the electric wire 1 terminal 702, but can vibrate freely in the hole. When the steel wire is in the vertical position, the clearance between the steel wire 703 and the holder terminal 702 is about 1 mm. An electric wire 7031 is connected to the steel wire just above socket 703*a.* Referring to FIGS. 1 and 2 several holes 705 are symmetrically disposed with respect to axis 3*a* in the lower dish body 2 with transparent plastic half-sphere shields 704*a, b,* . . . are inserted in holes 705. Referring to FIG. 1, mini motor 4 is parallel-circuited with a light bulb 8 and series circuited with sliding main switch 9 to control power. The vibrating switch composed of vibrating steel wire 703 and terminal 702 should be series connected to bulb 8, but parallel connected with the mini motor 4. Thus, when vibrating switch 11 is off, the mini motor is not influenced. Referring to FIG. 2, the gyroscope having a lower gravity center, the cont-type tip 2031 at the end of the supporting column 203 under the lower dish body 2 can either be combined with hole 302 of the stool-base 3 to elevate the total gyroscope to a higher standing position, or only stand in the cone hole on the T-type stool-base 3.

Figure 4:
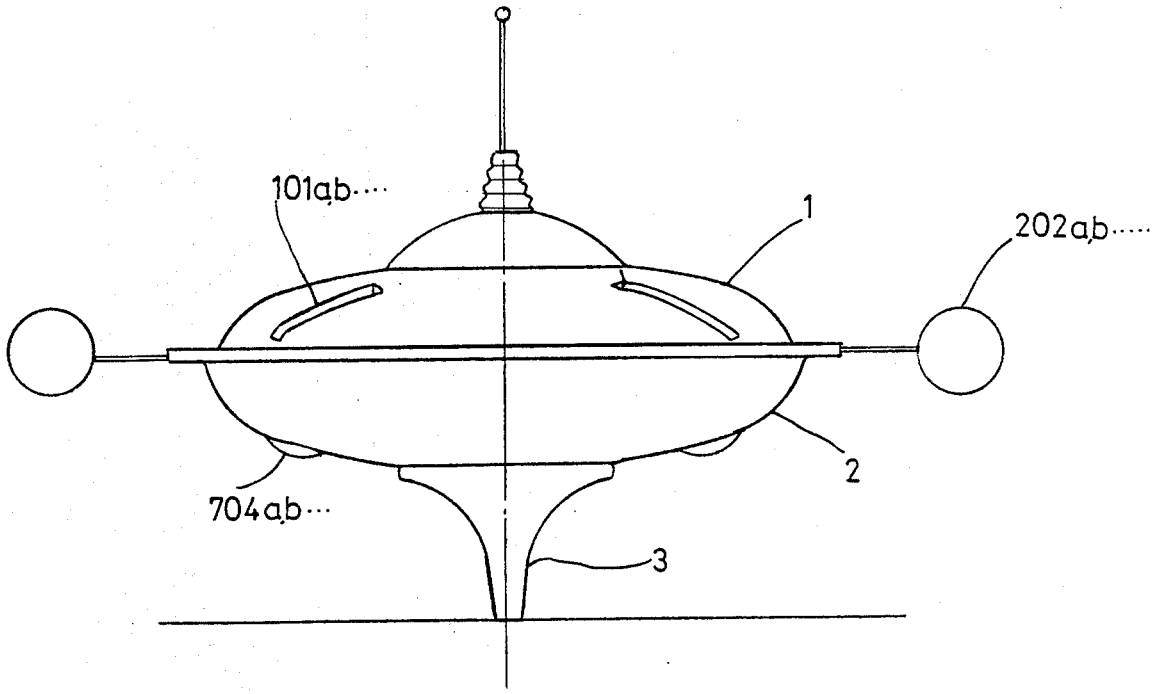
FIG. 4 shows the invention combined with the stool-base on the ground as a gyroscope.

According to the operation of this invention, the gyroscope should be lifted and held at the lower part of the lower dish body 2 and the sliding switch 9 pushed to the "on" position. The batteries 5*a, b,* are connected with the mini-motor 4 to supply power to drive upper rotor 1 to a high speed clockwise rotation up to 3000 RPM. Then the whole gyroscope is placed either on the ground or on the cone hole 302 of the stool-base 3. The gyroscope will stand by itself after it is released. The slits 101*a, b,* on the surface of the high-speed rotating upper rotor 1 will buzz continuously. Meanwhile, due to the reaction force, the lower dish body 2 will rotate in a counterwise direction at a very slow speed. Because the shaft of motor 401 can't be absolutely concentric with the upper rotor 1. (In any case, these two members may be purposely eccentrically assembled). The rotating unbalanced force of the upper rotor will cause the motor and the whole gyroscope to vibrate. Referring to FIG. 2, the vibration will effect the vibrating steel wire 703 to vibrate and to contact irregularly with the wire terminal 702 that is fixed on the inside wall of the terminal holder 7 clamped in groove 206*a* between semicircular holders 204*a* and 204*b*. This irregular contact causes light bulb 8 to turn on and off intermittently. The light flashing irregularly from bulb 8 is emitted through the transparent plasticballs 704*a, b,* under the lower dish body 2. In this way, the spaceship gyroscope experiences high speed rotation, continuous high frequency buzzing, irregular flashing accompanied by satellite-like slow-speed rotation, to imitate the magic effect of a spaceship so as to be an interesting and attractive toy. If lower dish body 2 is fit onto the cone hole 363 of the stool-base 3 as illustrated in FIG. 4, the abdomen 306 of the lower dish body 2 will fit with the concave surface 303 of the stool-base 3 so that the gyroscope will stand in a higher elevation. The gyroscope can then stand directly on the ground and slowly spin after the upper rotor 1 is driven to rotate rapidly. When the batteries 5*a* and 5*b* run out, it is necessary only to hold the knurled stud 102 on the upper rotor and pull the upper rotor away from the shaft of the motor 4 to change batteries.

The flange 201 on the lower dish body 2 protects the shaft of the mini motor from bending when wrong operation causes impact.

Figure 5:
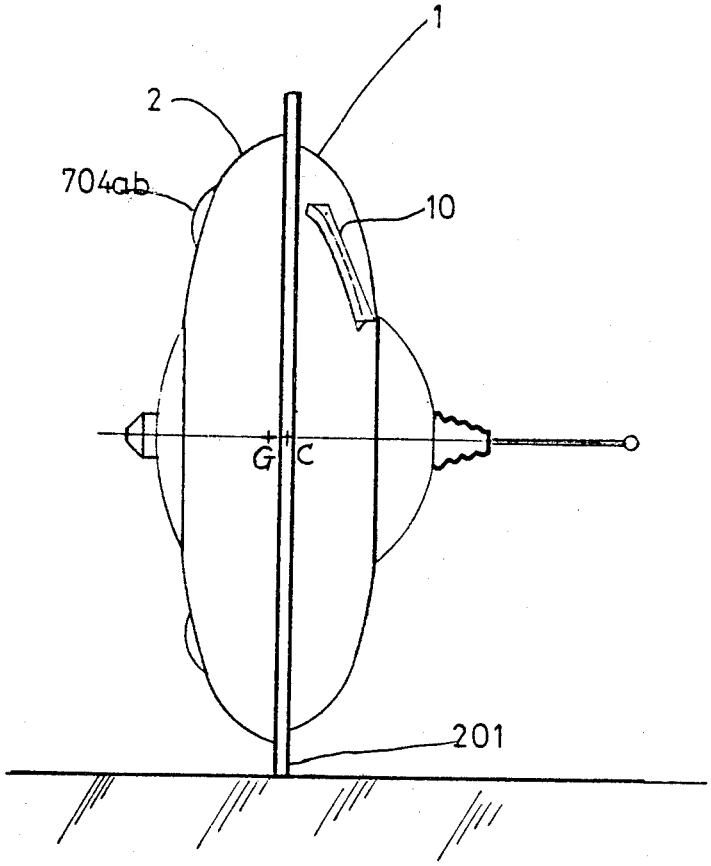
FIG. 5 shows the invention rotated 90° on the ground as a monocycle.

The invention may be used in an alternative manner. Referring to FIG. 5 the satellite sets 202*a, b,* . . . extending from the flange 201 around the lower body 2, may be removed and the propulsion leaves 10 fixed into the slots 101 on the upper rotor 1 with a pin. Owing to the gyroscope action of the upper rotor 1, the reaction of the propulsion force of the inserted leaves 10 to the air, and the eccentricity of the center of gravity of the gyroscope with the center of the flange 201, the gyroscope will rotate on the flange 201 in a circle.

I claim:

1. A flying saucer-shaped gyroscope toy comprising:

a circular dish-shaped rotor having a circular lower edge surrounding a first axis of rotation at its center and slits therein symmetrically disposed with respect to said first axis of rotation; said slits causing a buzzing sound when said rotor rotates;

a lower circular dish-shaped body having a second axis of rotation aligned with said first axis of rotation, a circular upper edge having the same diameter as the diameter as said circular lower edge of said rotor and a point edge at its bottom surface along said second axis of rotation;

a d.c. motor mounted in said lower body along said second axis of rotation and having a drive shaft extending along said second axis of rotation and engageable with said rotor along said first axis of rotation for driving said rotor to rotate, said gyroscope being supported on its point edge by gyroscopic action;

means for vertically supporting said rotor and body for rotation about said first axis of rotation when said means is in a first orientation or a second orientation with respect to said body, said means being rotatable with said body in said first orientation, said body rotating in relation to said means in said second orientation;

electric light means, including a light source mounted in said body, for providing light when said rotor is rotating in response to said motor;

said electric light means including a vibrating switch for turning said light source on and off when said rotor is caused to rotate by said motor; and a plurality of satellite bodies fixedly mounted to said lower body adjacent said upper circular edge symmetrically disposed in relation to said second axis of rotation.

2. Apparatus as in claim 1 wherein said rotor includes a knurled cone shaped upper portion symmetrically disposed with respect to said first axis of rotation, and means for engaging said drive shaft such that said rotor may be removed from engagement with said drive shaft by lifting upward at said knurled cone-shaped upper portion.

3. Apparatus as in claim 2 wherein said lower body includes a cone-shaped stud at said point edge for supporting at its lip said lower body during gyroscopic action, said supporting means consisting of a T-shaped support having a horizontal crossing portion and a vertical portion, said cone-shaped stud being insertable into said crossing portion of said T-shaped support when said T-shaped support is in said first orientation and being mountable on said vertical portion of said T-shaped support when said T-shaped support is in said second orientation.

4. Apparatus as in claim 1 wherein said lower body includes a circumferential flange disposed at said upper circular edge.

5. Apparatus as in claim 1 wherein said lower body includes a plurality of transparent hemispherical shields for transmitting light from said bulb to outside said lower body.

6. Apparatus as in claim 1 wherein said lower body includes two semicircular half sleeves surrounding said second axis of rotation for spring mounting said motor therein.

7. Apparatus as in claim 1 or claim 6 wherein said drive shaft includes key means for engaging and driving said rotor without slippage.

8. Apparatus as in claim 1 wherein said vibrating switch includes a terminal holder having a cave in the underside thereof clamped between said two semicircular leaves, a wire terminal mounted in said cave; a stiff wire disposed parallel said second axis of rotation with a lower end mounted to said lower body and an upper end extending into said cave in spaced relation to said terminal such that said stiff wire can vibrate freely in said cave into and out of control with said terminal when said motor rotates said rotor; and circuit means connecting a stiff wire and said terminal to said d.c. power source so that said light source flashes when said wire vibrates into contact with said terminal.

9. Apparatus as in claim 4 wherein said satellite bodies are removable from said flanges and propulsion leaves are insertable in said slits so that said body and rotor may rotate as a monocycle in a circle on said flange.

* * * * *